US011000891B2

(12) United States Patent
Simpson et al.

(10) Patent No.: US 11,000,891 B2
(45) Date of Patent: May 11, 2021

(54) BLIND FASTENER TOOL WITH PULLING FINGERS

(71) Applicant: The Boeing Company, Chicago, IL (US)

(72) Inventors: Blake A Simpson, Kent, WA (US); David G Ellsworth, Kent, WA (US); Casey M Cowell, Renton, WA (US); Stephen G Holley, Gig Harbor, WA (US)

(73) Assignee: The Boeing Company, Chicago, IL (US)

( * ) Notice: Subject to any disclaimer, the term of this patent is extended or adjusted under 35 U.S.C. 154(b) by 295 days.

(21) Appl. No.: 16/254,905

(22) Filed: Jan. 23, 2019

(65) Prior Publication Data

US 2020/0230691 A1 Jul. 23, 2020

(51) Int. Cl.

| | |
|---|---|
| ***B21J 15/30*** | (2006.01) |
| ***B21J 15/10*** | (2006.01) |
| ***B21J 15/38*** | (2006.01) |
| ***B21J 15/04*** | (2006.01) |

(52) U.S. Cl.

CPC ..... *B21J 15/30* (2013.01); *B21J 15/043* (2013.01); *B21J 15/105* (2013.01); *B21J 15/383* (2013.01)

(58) Field of Classification Search

CPC ..... B21J 15/30; B21J 15/043; B21J 15/045; B21J 15/105; B21J 15/383; Y10T 29/53757; Y10T 29/53761; Y10T 29/5377; F16B 19/1072; F16B 19/1063; F16B 19/1045; F16B 19/1036

See application file for complete search history.

(56) References Cited

U.S. PATENT DOCUMENTS 3,357,094 A * 12/1967 Mouck ..... B25B 27/0014 29/509
3,774,437 A * 11/1973 Young ..... B21J 15/26 29/243.526
4,648,259 A * 3/1987 Pendleton ..... B21J 15/043 279/56

OTHER PUBLICATIONS

Cherry Aerospace; CherryMax Installation Stages; http://www.cherryaerospace.com/product/animations/cmaxanims; Jan. 15, 2019.

(Continued)

*Primary Examiner* — Tyrone V Hall, Jr.
(74) *Attorney, Agent, or Firm* — Duft & Bornsen, PC

(57) ABSTRACT

A blind fastener tool with pulling fingers is provided. One embodiment is a tool for installing a blind fastener in a hole. The tool includes stationary fingers having tips protruding from a front end of the housing to contact a rim of a sleeve of the blind fastener. The tool also includes pulling fingers in the housing arranged longitudinally in spaces between the stationary fingers. Ends of the pulling fingers proximate to the front end are configured to radially expand to receive a drive element of the blind fastener, and to radially collapse to grip a collar of the drive element. The pulling fingers are configured to translate inside the housing to pull the drive element away from the sleeve as the stationary fingers contact the rim of the sleeve to form a bulb with the sleeve at a blind side of the hole.

20 Claims, 6 Drawing Sheets

(56) References Cited

OTHER PUBLICATIONS

Didier Friot et al; LISI#OneSide, a Set of Solutions for Efficient Blind Fastener Installation; SAE International; Thursday Nov. 30, 2017.

Monogram Aerospace; Monogram Aerospace Fasteners; https://webcache.googleusercontent.com; Jan. 15, 2019 (http://www.monogramaerospace.com/files/active/61composi-lok animations 2014).

* cited by examiner

BLIND FASTENER TOOL WITH PULLING FINGERS

FIELD

The disclosure relates to assembly of structures, and in particular, to installing blind fasteners to a structure.

BACKGROUND

Blind fasteners, such as blind bolts or blind rivets, are used in aircraft assembly to mechanically unite various structural components of an aircraft. Unlike nut bolts which require access to both sides of the structure, blind fasteners can be completely installed from only one side of the structure, eliminating the need to access the back side. Previous blind fastener installation tools include a complex mechanical structure that is particularly limited in applications where fastener installation is performed at non-normal angles and/or with a sealant.

SUMMARY

Embodiments described herein provide a blind fastener tool with pulling fingers. The blind fastener tool improves blind installations by reducing tooling complexity and increasing tooling control of the fastener. The pulling fingers provide greater visual access to the fastener while in use and increased control in axial translation and radial rotation for installing the fastener at non-normal angles. Additional technical benefits include improved sealant accumulation prevention, robotic integration, and installation reliability.

One embodiment is a tool for installing a blind fastener in a hole. The tool includes a housing having a hollow longitudinal body and an open front end, and stationary fingers fixed in the housing and arranged longitudinally and angularly spaced. Tips of the stationary fingers protrude from the front end of the housing to contact a rim of a sleeve of the blind fastener. The tool also includes pulling fingers disposed in the housing and arranged longitudinally in spaces between the stationary fingers. Ends of the pulling fingers proximate to the front end are configured to radially expand to receive a drive element of the blind fastener, and to radially collapse to grip a collar of the drive element. The pulling fingers are configured to translate inside the housing to pull the drive element away from the sleeve as the stationary fingers contact the rim of the sleeve to form a bulb with the sleeve at a blind side of the hole.

Another embodiment is a tool including a housing configured to contain an internal drive mechanism configured to pull a drive element and a core bolt of a blind fastener to form a bulb with a sleeve of the blind fastener at a blind side of a hole, and to rotate the drive element to tighten the blind fastener in the hole via the bulb. The internal drive mechanism includes stationary fingers in the housing configured to contact a rim of the sleeve of the blind fastener to hold the sleeve in the hole, and pulling fingers in the housing configured to grip the drive element, and to slide laterally in the housing to pull the drive element and the core bolt to form the bulb. The internal drive mechanism further includes a torque sleeve radially inward from the stationary fingers and the pulling fingers, the torque sleeve configured to rotate the drive element to tighten the blind fastener in the hole via the bulb.

Yet another embodiment is a tool for installing a blind fastener. The tool includes an assembly configured to engage a drive portion of the blind fastener, and to pull and rotate the drive portion to form a bulb with a fastener portion of the blind fastener at a blind side of a hole. The assembly includes a housing including a longitudinal body and a hollow cavity, and a torque sleeve extending into the housing longitudinally and including a socket to receive the drive portion of the blind fastener for rotation. The assembly also includes a pull slide disposed longitudinally in the housing and radially outward from the torque sleeve, and configured to slide longitudinally via a drive actuator. The assembly further includes pulling fingers mechanically coupled with the pull slide and configured to engage a collar of the drive portion of the blind fastener, and to pull the collar of the drive portion via sliding of the pull slide, a locking slide disposed longitudinally in the housing and radially outward from the pulling fingers, and configured to slide to radially expand and collapse the pulling fingers to engage the drive portion with the pulling fingers. The assembly also includes stationary fingers disposed in the housing to abut against a rim of the fastener portion of the blind fastener, and configured to counteract a first pulling force on the drive portion via sliding of the pulling fingers to initiate formation of the bulb with the fastener portion of the blind fastener, and to counteract a second pulling force on the drive portion via rotation of the torque sleeve to tighten the fastener portion with bulb for installing the blind fastener in the hole.

Other illustrative embodiments may be described below. The features, functions, and advantages that have been discussed can be achieved independently in various embodiments or may be combined in yet other embodiments further details of which can be seen with reference to the following description and drawings.

DESCRIPTION OF THE DRAWINGS

Some embodiments of the present disclosure are now described, by way of example only, and with reference to the accompanying drawings. The same reference number represents the same element or the same type of element on all drawings.

DESCRIPTION

The figures and the following description illustrate specific illustrative embodiments of the disclosure. It will thus be appreciated that those skilled in the art will be able to devise various arrangements that, although not explicitly described or shown herein, embody the principles of the disclosure and are included within the scope of the disclosure. Furthermore, any examples described herein are intended to aid in understanding the principles of the disclosure, and are to be construed as being without limitation to such specifically recited examples and conditions. As a result, the disclosure is not limited to the specific embodiments or examples described below, but by the claims and their equivalents.

Figure 1A:
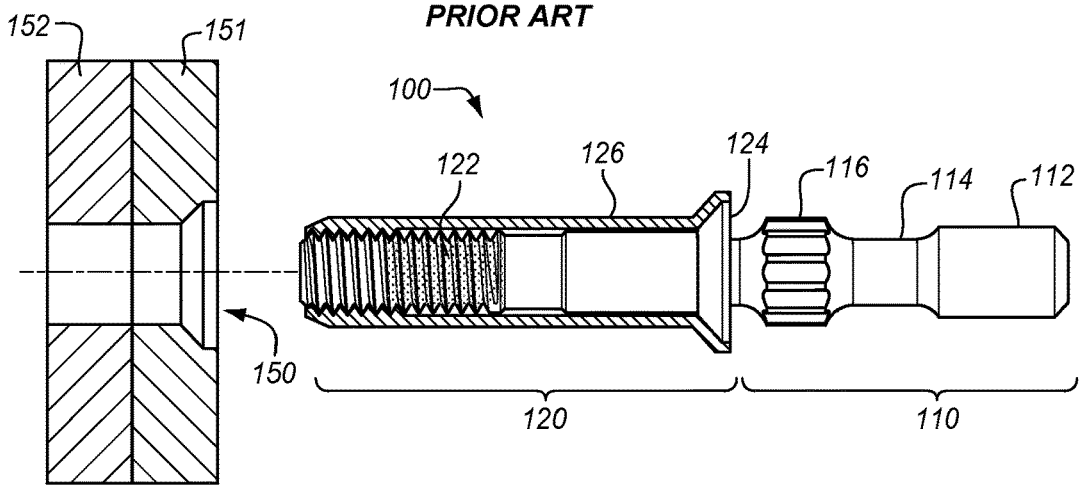
FIG. 1A PRIOR ART
FIG. 1A illustrates a blind fastener to be installed into a hole.
Figure 1B:
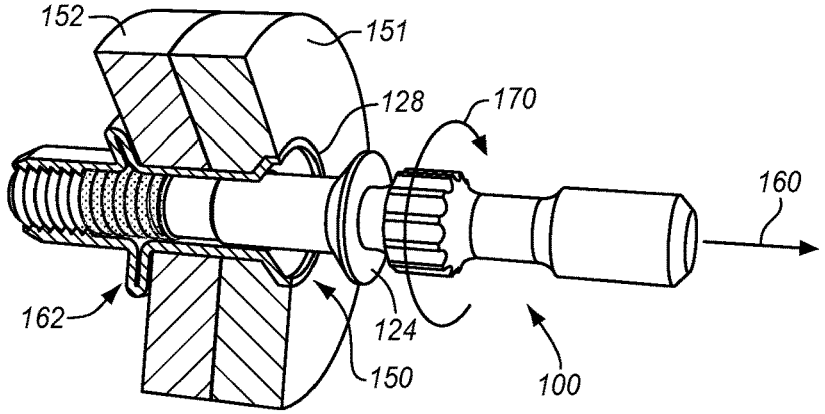
FIG. 1B PRIOR ART
FIG. 1B illustrates the blind fastener in mid-installation with the hole.
Figure 1C:
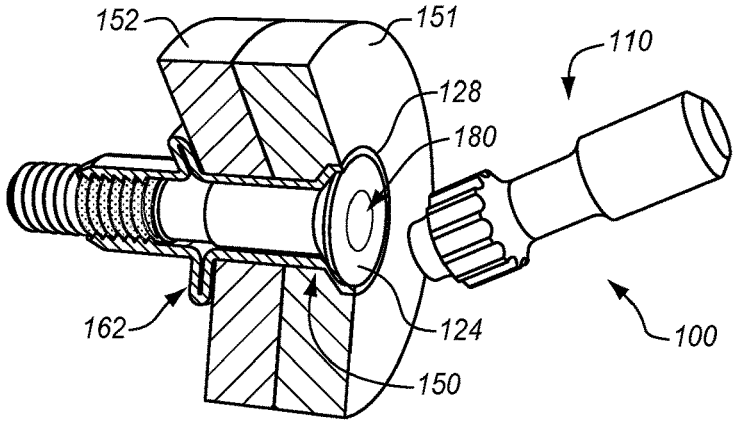
FIG. 1C PRIOR ART
FIG. 1C illustrates the blind fastener installed in the hole.

FIGS. 1A-1C illustrate the installation of a blind fastener 100 with respect to a hole 150. The blind fastener 100 shown and described with respect to FIGS. 1A-1C is an example pull and twist type blind fastener that is known for performing one-sided fastener installation. The blind fastener tool to be described below may operate with similar blind fasteners or with alternative blind fasteners having a different configuration for pull and twist installation.

FIG. 1A illustrates a blind fastener 100 to be installed into a hole 150. The blind fastener 100 is generally useful for fastening structures 151-152 together where a front structure 151 is accessible to an operator's hand or tool but a back structure 152 may not be accessible.

The blind fastener 100 comprises a drive portion 110 (sometimes referred to as a drive element) and a fastener portion 120. Generally, the drive portion 110 interfaces with an installation tool, and the fastener portion 120 installs into the hole 150. In this example, the drive portion 110 includes a centering section 112, a pull section 114, and a drive section 116. The fastener portion 120 includes a core bolt 122, a shank head 124, and a fastener sleeve 126.

FIG. 1B illustrates the blind fastener 100 in mid-installation with the hole 150. As shown in FIG. 1B, the blind fastener 100 is a pull and twist type fastener in which, after the fastener portion 120 is properly positioned in the hole 150, the drive portion 110 is pulled by a pulling force 160 away from the hole 150 to initially generate a bulb 162 on the back side of the hole 150. Upon applying the pulling force 160, the fastener sleeve 126 remains in the hole 150 as the rest of the blind fastener 100 translates, causing the fastener sleeve 126 to collapse in a controlled fashion against the surface of the back structure 152 and form the bulb 162 which acts as a nut in a traditional bolt and nut fastener.

Additionally, upon applying the pulling force 160, the shank head 124 is pulled off the front of the hole 150 and away from a rim 128 of the fastener sleeve 126 which remains flush with the front surface of the hole 150. After initial formation of the bulb 162 via pulling, the drive section 116 is rotated by a rotation force 170 to drive the drive portion 110 and core bolt 122 back into the fastener sleeve 126 and the hole 150. As the shank head 124 seats into the fastener sleeve 126 again, the blind fastener 100 tightens the structures 151-152 together between the shank head 124 and the bulb 162.

FIG. 1C illustrates the blind fastener 100 installed in the hole 150. As the core bolt 122 is further driven via rotation to clamp the hole 150, rotational torque increases and causes a corresponding increase in pulling force acting on the drive portion 110 of the blind fastener 100. When the designed force is reached, the drive portion 110 is configured to breakoff under the applied forces. That is, the drive portion 110 undergoes a separation 180 from the core bolt 122 due to a groove designed to break at a particular applied force. The fastener portion 120 is thus installed in the hole 150 with the shank head 124 and the exposed rim 128 of the fastener sleeve 126 flush with a front-side of the hole 150. The drive portion 110 may be discarded into a collector to avoid foreign object debris in the job site. The blind fastener 100 including the fastener portion 120 is thus fully installed into the hole 150 to clamp the structures 151-152 together via one-sided installation. Fasteners with non-flush head styles can be installed in a similar fashion. In this case, the head of the fastener rests atop the sleeve rim 128 and the structure.

Previous blind fastener installation tools include a complex mechanical structure that is susceptible to inefficiencies. These tools are particularly limited in applications where installation is performed at non-normal angles and/or in the presence of sealant. For example, sealant can adhere to, and subsequently jam or plug, the internal drive mechanism of these tools, potentially resulting in costly manufacturing downtime to clean its internal drive mechanism.

Figure 2:
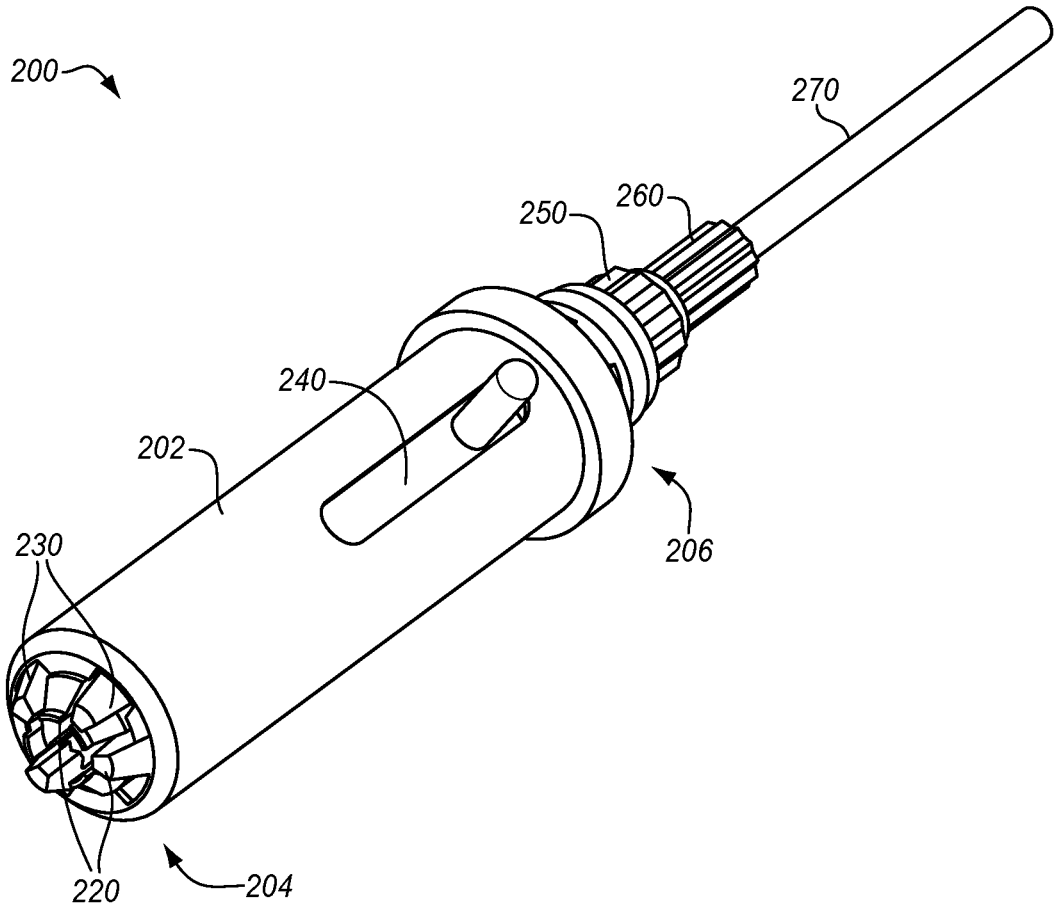
FIG. 2 is a perspective view of a blind fastener tool in an illustrative embodiment.

FIG. 2 is a perspective view of a blind fastener tool 200 in an illustrative embodiment. As described in greater detail below, the blind fastener tool 200 is enhanced with an internal drive mechanism to perform pull and twist blind fastener installations in a simplified configuration that improves tooling control of the blind fastener and prevents sealant from clogging its components. The blind fastener tool 200 includes a housing 202 comprising a hollow longitudinal body with a first open end 204 and a second open end 206. The housing 202 contains the internal drive mechanism configured to pull a drive element of a blind fastener to form a bulb with a sleeve of the blind fastener at a blind side of a hole, and to rotate the drive element to tighten the blind fastener in the hole via the formed bulb on the blind side. The internal drive mechanism action of pulling and rotating of the drive element installs the fastener portion of the blind fastener (not shown in FIG. 2) in a hole similar to that described above with respect to FIGS. 1A-1C.

To improve blind fastener installations, the blind fastener tool 200 is enhanced with stationary fingers 220 and pulling fingers 230. The stationary fingers 220 are configured to contact a rim of the sleeve of the blind fastener (not shown in FIG. 2, see e.g., rim 128 of FIG. 1B), and the pulling fingers 230 are configured to grip the drive element, and to slide longitudinally in the housing 202 to pull the drive element (e.g., and core bolt 122) while the rim is held by the stationary fingers 220 to form the bulb (not shown in FIG. 2, see e.g., bulb 162 of FIG. 1B). The stationary fingers 220 are fixed and arranged in the housing 202 longitudinally such that tips of the stationary fingers 220 protrude from the first open end 204. The pulling fingers 230 are arranged in the housing 202 longitudinally such that tips of the pulling fingers 230 are proximate to the first open end 204 when the pulling fingers 230 are slid forward. Thus, in applications where a sealant is applied for installing a blind fastener to a hole, the tips of the stationary fingers 220 and pulling fingers 230 advantageously prevent sealant from entering into the pull and twist mechanism in the housing 202 as the drive element is inserted into the blind fastener tool 200.

The pulling fingers 230 are further configured to open radially to load/eject the drive element, and to close radially to engage a circular collar (i.e., pulling surface) of the drive element for pulling. Radial movement of the pulling fingers 230 advantageously enables improved grip and support of the drive element when the drive element is seated in the blind fastener tool 200 to perform blind fastener installations at non-normal angles. As described in further detail below, the pulling fingers 230 open and close radially via actuation of a locking slide 240 that translates in the housing 202. The pulling fingers 230 translate axially (e.g., laterally forward and backward in the housing 202) via actuation of a drive actuator 250 proximate to the second open end 206 of the housing 202. A torque sleeve 260 disposed longitudinally through the second open end 206 of the housing 202 is configured to rotate the drive element after pulling to complete fastener installation. The blind fastener tool 200 may also include an ejector rod 270 to eject the drive element after the drive element has separated from the installed portion of the blind fastener.

Figure 3:
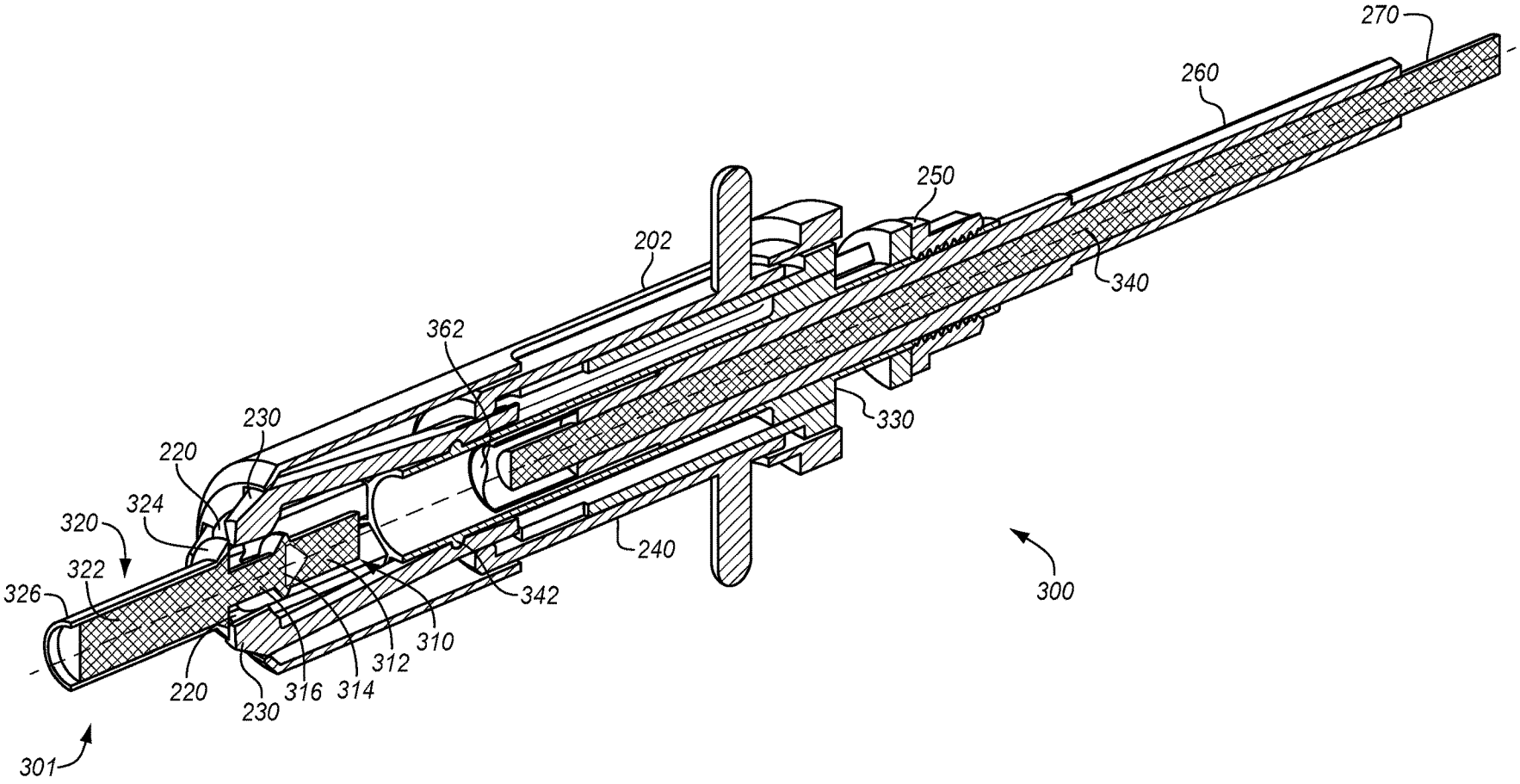
FIG. 3 is a perspective cross-sectional view of a blind fastener tool in an illustrative embodiment.

FIG. 3 is a perspective cross-sectional view of a blind fastener tool 300 in an illustrative embodiment. FIG. 3 illustrates the internal arrangement of components of the blind fastener tool 300 described above with respect to the blind fastener tool 200 of FIG. 2, including the housing 202, the stationary fingers 220, the pulling fingers 230, the locking slide 240, the drive actuator 250, the torque sleeve 260, and the ejector rod 270. As further shown in FIG. 3, the assembly of components of the blind fastener tool 300 engage with a drive element 310 of a blind fastener 301, and pull/rotate the drive element 310 to form a bulb with a fastener portion 320 of the blind fastener 301 at a blind side of a hole, thereby installing the blind fastener 301 in the hole.

In this example, the blind fastener 301 includes the drive element 310 having a drive tab 312, a collar 314, and a neck 316, and further includes the fastener portion 320 having a core bolt 322, a shank head 324, and a fastener sleeve 326. One advantage of the blind fastener tool 300 is that it is operable with blind fasteners, such as the blind fastener 301, which are simpler, more cost effective, and more efficient than the blind fastener 100 described above with respect to FIGS. 1A-1C. In particular, although the blind fastener comprises a pull and twist type fastener to install the fastener portion 320, the drive tab 312 that includes the wrench flats or rotation surfaces is distal from the fastener portion 320. The drive tab 312 may thus seat directly into the torque sleeve 260 for rotation without any leading centering section (e.g. centering section 112) inserted into the internal mechanism of the blind fastener tool 300. In addition, manufacturing costs for the drive tab 312 may be reduced, thus providing a recurring cost saving. However, it will be appreciated that the features of the blind fastener tool 300 described herein are applicable to alternative configurations and types of blind fasteners.

As further shown in FIG. 3, the blind fastener tool 300 includes a pull slide 330 arranged longitudinally in the housing 202 and radially inside the locking slide 240. The pull slide 330 and the locking slide 240 are configured to translate in the housing 202 along a longitudinal axis 340 to operate the pulling fingers 230. More particularly, translation of the locking slide 240 opens and closes the pulling fingers 230 radially with respect to the longitudinal axis 340 via a hinge mechanism 342, and translation of the pull slide 330 moves the pulling fingers 230 back and forth along the longitudinal axis 340. The sliding action of the pull slide 330 thus generates initial formation of a bulb (e.g., bulb 162) via collapsing of the fastener sleeve 126 at the blind side of a hole. That is, the pull slide 330 translates the pulling fingers 230 and the core bolt 322 via and the drive element 310 gripped by the pulling fingers 230 for a sufficient length to form the bulb with the fastener sleeve 326 of the blind fastener 301.

The blind fastener tool 200 further includes the torque sleeve 260 with one end extending along the longitudinal axis 340 into the housing 202. The end of the torque sleeve 260 includes a socket cavity 362 to receive the drive tab 312 for rotating the blind fastener 301. Alternatively, in some embodiments, the torque sleeve 260 may include two or more tabs that sandwich the drive tab 312 for rotating the blind fastener 301. The torque sleeve 260 slides/rotates at a position radially inward from the pull slide 330. In other words, the torque sleeve 260 is located radially inward from the stationary fingers 220 and the pull fingers 230 to apply rotational force to the drive tab 312. Initial rotation of the torque sleeve 260 allows engagement with the drive tab 312. In some embodiments, the torque sleeve 260 is spring-loaded to allow insertion of the drive tab 312 prior to alignment. With the drive tab 312 seated in the socket cavity 362, rotation of the torque sleeve 260 completes the formation of the back-side bulb, tightens the core bolt 322 within the fastener sleeve 326, and breaks the drive element 310 cleanly away from the fastener portion 320, thereby installing the blind fastener 301 in a blind side hole.

As earlier described, the stationary fingers 220 abut against a top rim (e.g., rim 128) of the fastener sleeve 126 to hold the fastener sleeve 126 in the hole during the installation sequence and react the pulling forces acting on the drive element 310 of the blind fastener 301. That is, the stationary fingers 220 counteract a first pulling force on the drive element 310 and the core bolt 322 via sliding of the pulling fingers 230, and also counteract a second pulling/torsion force on the drive element 310 and the core bolt 322 via rotation of the torque sleeve 260 to tighten the fastener portion 320 via the formed bulb for installing the blind fastener 301 in the hole.

Figure 4:
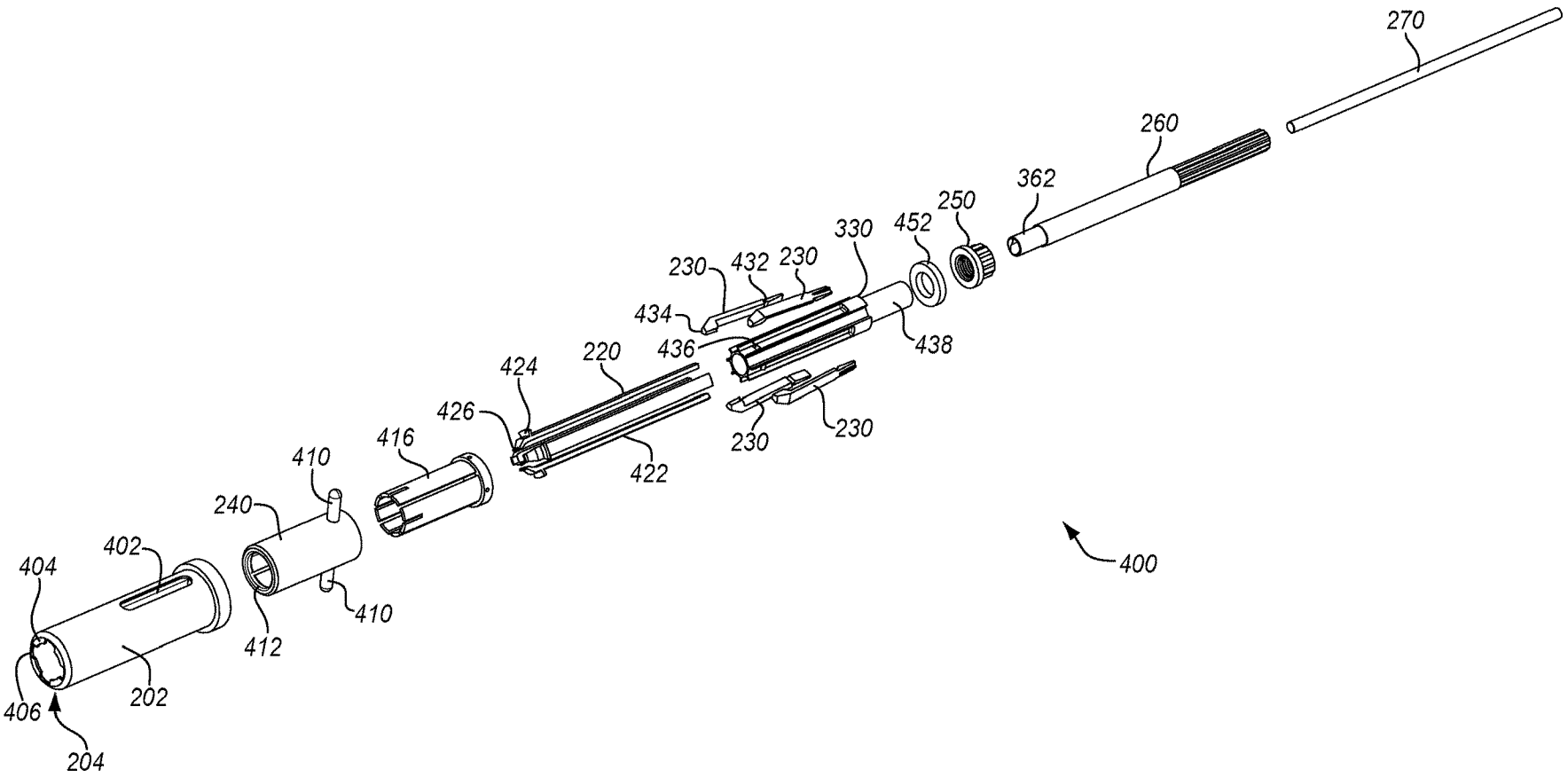
FIG. 4 is an exploded view of a blind fastener tool in an illustrative embodiment.

FIG. 4 is an exploded view of a blind fastener tool 400 in an illustrative embodiment. FIG. 4 illustrates additional features of the components described above. In particular, the housing 202 includes a tubular member with longitudinal notches 402 on opposing sides. The longitudinal notches 402 accommodate arms 410 on opposing sides of the locking slide 240. The arms 410 extend perpendicularly, or radially, outward from the hollow tubular member comprising the locking slide 240, and further extend through the longitudinal notches 402 so that the arms 410 are exposed outside the housing 202. This allows an operator or tool to access and apply a force to the arms 410 to translate the locking slide 240 and control the pulling fingers 230 to radially expand or collapse.

The housing 202 may also include rim guards 404 disposed around the rim or front of the first open end 204. The rim guards 404 protrude radially inward from the rim and the stationary fingers 220 may radially align inward from the rim guards 404 to form finger notches 406 at the first open end 204. Additionally, the annular arrangement of the rim guards 404, the stationary fingers 220, and the pulling fingers 230 advantageously protect the first open end 204 from sealant while still enabling the blind fastener tool 400 to receive and dispose a drive element.

The stationary fingers 220 in this example comprise four longitudinal members with spaces 422 between the longitudinal members. That is, the stationary fingers 220 may be disposed around an interior of the housing 202 with equal radial spacing. A front end 424 of the stationary fingers 220 includes tapered tips 426 that serve to hold the fastener in the hole during the installation sequence. The exposed rim of the fastener sleeve may be narrow (e.g., as small as 0.020 to 0.030 inches), and the tapered tips 426 are sized to remain on top of the rim to avoid damage to the surrounding structural material.

Furthermore, the pulling fingers 230 in this example also comprise four longitudinal members configured to be arranged in parallel with the stationary fingers 220 and in the spaces 422 of the stationary fingers 220. The pulling fingers 230 may thus also be disposed around the interior of the housing 202 with equal radial spacing, and radially alternating or offset with the pulling fingers 230. In this example having four fingers for each set, the pulling fingers 230 are offset forty-five degrees from the stationary fingers 220. However, it will be appreciated that alternative configurations and numbers of fingers for the pulling fingers 230 and the stationary fingers 220 are possible.

The pulling fingers 230 include slide attachment joints 432 to mechanically couple the pulling fingers 230 and the pull slide 330. The slide attachment joints 432 mate with corresponding attachment points 436 disposed around an exterior of the tubular body of the pull slide 330. In addition to coupling the pulling fingers 230 and the pull slide 330 for lateral movement, this arrangement provides a technical benefit by enabling the pulling fingers 230 to pivot for increased handling control of a drive element. For instance, referring back to FIG. 3, a front inner lip 412 of the locking slide 240, the attachment joints 432 of the pulling fingers 230, and the attachment points 436 of the pull slide 330 are in proximal radial alignment to form the hinge mechanism 342 to radially expand and contract the pulling fingers 230.

The pulling fingers 230 may thus be configured to open, either via the hinge mechanism 342 or spring action, to accept a drive element. After the drive element is properly seated in the socket cavity 362 of the torque sleeve 260, the pulling fingers 230 are configured to close to engage the circular collar of the drive element. The pulling fingers 230 may thus further include hooked front ends 434 that provide a pulling surface to oppose the back surface of the collar so that the pulling fingers 230 do not slide over the collar during the pulling operation.

The drive actuator 250 and nut 452 fit over a back end 438 of the pull slide 330 extending outside the second open end 206 of the housing 202. The drive actuator 250 is configured to move the pull slide 330 laterally. The drive actuator 250 may include threaded or non-threaded configurations to engage the pull slide 330. In some embodiments, the blind fastener tool 400 is configured to engage with a power tool that receives and rotates the drive actuator 250 to translate the pull slide 330 and the pulling fingers 230. In further embodiments, the blind fastener tool 400 includes a retainer sleeve 416 configured to retain the stationary fingers 220, and to guide the pulling fingers 230. That is, the stationary fingers 220 may be held in place inside the housing 202 by the retainer sleeve 416. Alternatively or additionally, the stationary fingers 220 may be configured to move radially to allow fastener insertion and accommodate fasteners of various radius sizes.

Figure 5A:
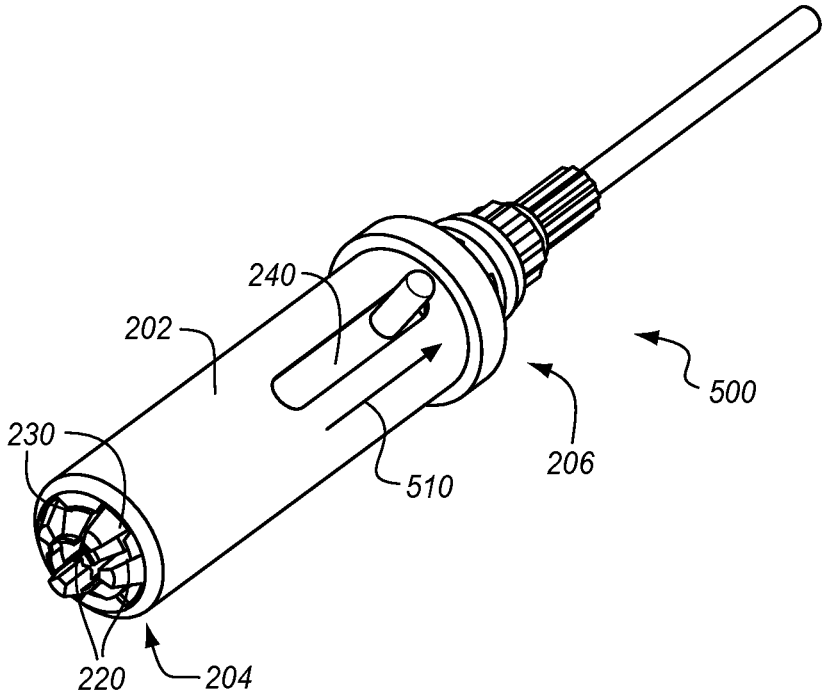
FIG. 5A is a perspective view of the blind fastener tool actuated to open the pulling fingers.
Figure 5B:
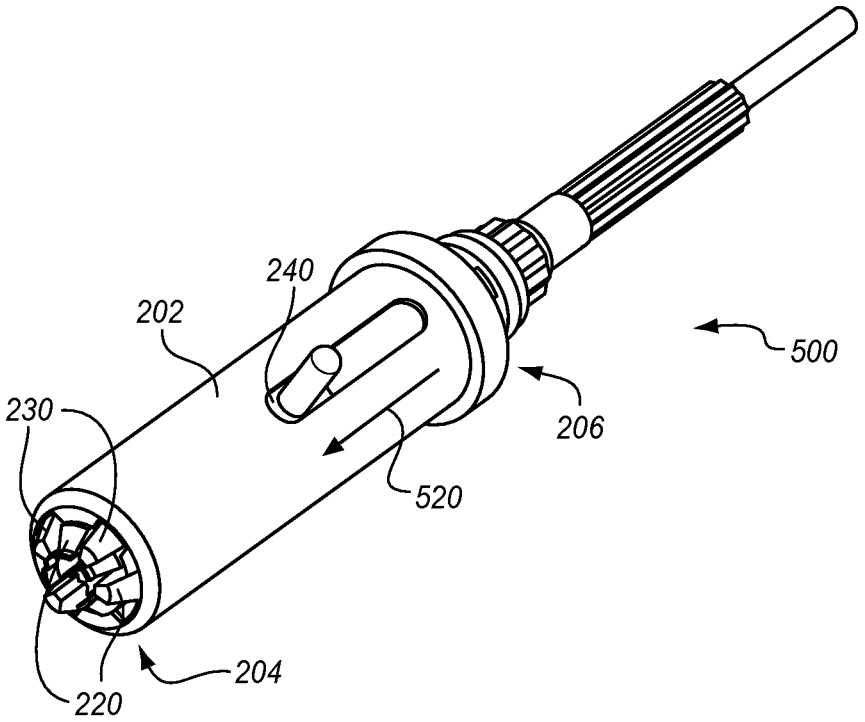
FIG. 5B is a perspective view of the blind fastener tool actuated to close the pulling fingers.
Figure 5C:
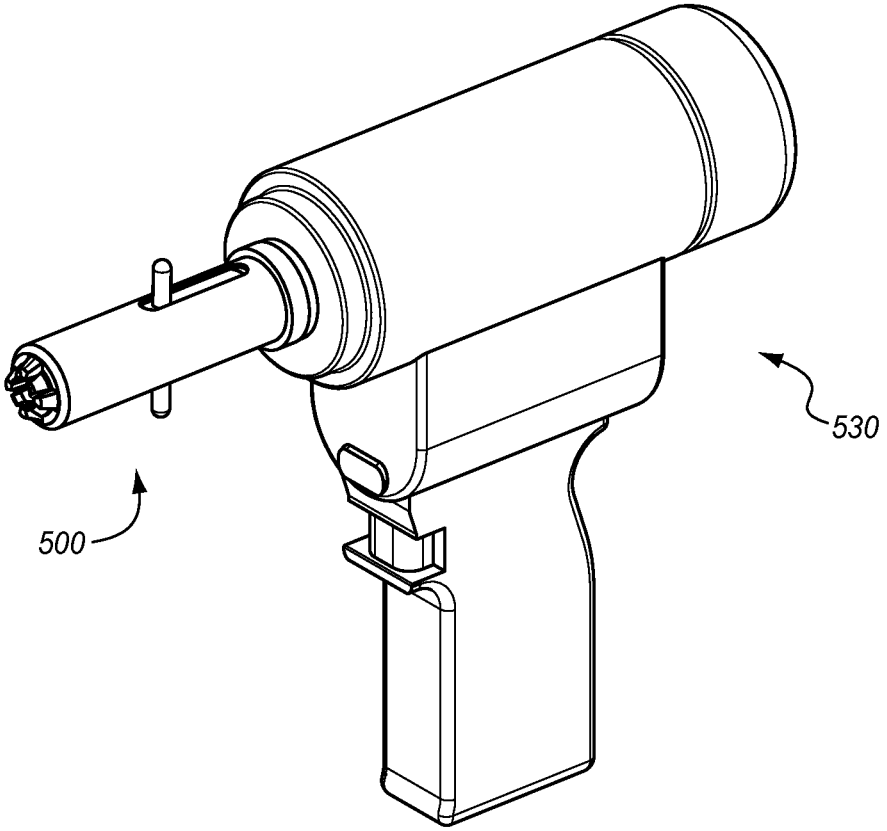
FIG. 5C is a perspective view of the blind fastener tool engaged with a power tool.

FIGS. 5A-5C show additional perspective views of a blind fastener tool 500. FIG. 5A is a perspective view of the blind fastener tool 500 actuated to open the pulling fingers 230. In particular, the locking slide 240 is translated in a backward direction 510 (e.g., toward the second open end 206) to radially open the pulling fingers 230 for loading/ejecting a drive element. FIG. 5B is a perspective view of the blind fastener tool 500 actuated to close the pulling fingers 230. That is, the locking slide 240 is translated in a forward direction 520 (e.g., toward the first open end 204) to radially close the pulling fingers 230 for pulling/twisting a drive element. FIG. 5C is a perspective view of the blind fastener tool 500 engaged with a power tool 530. The blind fastener tool 500 may thus comprise a tool nosepiece integrated within a tool. The power tool 530 may rotate the drive actuator 250 to pull the drive element and initially form the bulb at the blind side of the hole. The power tool 530 may also engage the external tubular body of the torque sleeve 260 to rotate the drive element and complete installation of the blind fastener into the hole.

Although specific embodiments are described herein, the scope of the disclosure is not limited to those specific embodiments. The scope of the disclosure is defined by the following claims and any equivalents thereof.

What is claimed is:

1. A tool for installing a blind fastener in a hole, the tool comprising:

a housing including a hollow longitudinal body and an open front end;

stationary fingers fixed in the housing and arranged longitudinally and angularly spaced, wherein tips of the stationary fingers protrude from the front end of the housing to contact a rim of a sleeve of the blind fastener; and pulling fingers disposed in the housing and arranged longitudinally in spaces between the stationary fingers, wherein ends of the pulling fingers proximate to the front end are configured to radially expand to receive a drive element of the blind fastener, and to radially collapse to grip a collar of the drive element, and wherein the pulling fingers are configured to translate inside the housing to pull the drive element away from the sleeve as the stationary fingers contact the rim of the sleeve to form a bulb with the sleeve at a blind side of the hole.

2. The tool of claim 1 further comprising:

a torque sleeve disposed radially inward from the stationary fingers and the pulling fingers, the torque sleeve configured to rotate the drive element to install the blind fastener with the hole.

3. The tool of claim 2 wherein:

the torque sleeve includes a longitudinal member extending into an open back end of the housing, the longitudinal member including a socket cavity at one end to receive the drive element for rotation.

4. The tool of claim 1 wherein:

the stationary fingers and the pulling fingers alternate with one another around an inside the housing.

5. The tool of claim 4 wherein:

the pulling fingers include hooked ends configured to radially close behind the collar of the drive element to pull the drive element.

6. The tool of claim 5 wherein:

the spaces between the stationary fingers at the front end of the housing accommodate radial movement of the hooked ends of the pulling fingers at the front end of the housing.

7. The tool of claim 5 wherein:

the hooked ends of the pulling fingers and ends of the stationary fingers are configured to form a seal at the front end of the housing to prevent sealant from entering the tool as the drive element enters the front end.

8. A tool comprising:

a housing configured to contain an internal drive mechanism configured to pull a drive element and a core bolt of a blind fastener to form a bulb with a sleeve of the blind fastener at a blind side of a hole, and to rotate the drive element to tighten the blind fastener in the hole via the bulb, the internal drive mechanism comprising:

stationary fingers in the housing configured to contact a rim of the sleeve of the blind fastener to hold the sleeve in the hole;

pulling fingers in the housing configured to grip the drive element, and to slide laterally in the housing to pull the drive element and the core bolt to form the bulb; and a torque sleeve radially inward from the stationary fingers and the pulling fingers, the torque sleeve configured to rotate the drive element to tighten the blind fastener in the hole via the bulb.

9. The tool of claim 8, wherein the internal drive mechanism further comprises:

a locking slide disposed in the housing radially outward from the pulling fingers, and configured to slide laterally in the housing to radially expand and collapse the pulling fingers to engage the drive element with the pulling fingers.

10. The tool of claim 9, wherein:

the locking slide includes one or more arms extending through notches in a side of the housing, the arms configured to slide in the notches to translate the locking slide in the housing.

11. The tool of claim 8, wherein the stationary fingers include tips arranged around an interior front rim of the housing to hold the rim of the sleeve in the hole.

12. The tool of claim 8, wherein the stationary fingers configured to react a pulling force of the pulling fingers on the drive element to form the bulb.

13. The tool of claim 8, wherein:

the stationary fingers, the pulling fingers, and the torque sleeve are arranged longitudinally with the housing.

14. A tool for installing a blind fastener, the tool comprising:

an assembly configured to engage a drive portion of the blind fastener, and to pull and rotate the drive portion to form a bulb with a fastener portion of the blind fastener at a blind side of a hole, the assembly comprising:

a housing including a longitudinal body and a hollow cavity;

a torque sleeve extending into the housing longitudinally and including a socket to receive the drive portion of the blind fastener for rotation;

a pull slide disposed longitudinally in the housing and radially outward from the torque sleeve, and configured to slide longitudinally via a drive actuator;

pulling fingers mechanically coupled with the pull slide and configured to engage a collar of the drive portion of the blind fastener, and to pull the collar of the drive portion via sliding of the pull slide;

a locking slide disposed longitudinally in the housing and radially outward from the pulling fingers, and configured to slide to radially expand and collapse the pulling fingers to engage the drive portion with the pulling fingers; and stationary fingers disposed in the housing to abut against a rim of the fastener portion of the blind fastener, and configured to counteract a first pulling force on the drive portion via sliding of the pulling fingers to initiate formation of the bulb with the fastener portion of the blind fastener, and to counteract a second pulling force on the drive portion via rotation of the torque sleeve to tighten the fastener portion with a bulb for installing the blind fastener in the hole.

15. The tool of claim 14, wherein:

the pulling fingers are configured to radially expand and collapse to receive the drive portion into the socket and to close around the collar of the drive portion for pulling.

16. The tool of claim 14, wherein:

the pulling fingers are configured to pivot about a point of attachment with the pull slide.

17. The tool of claim 14, wherein:

the pulling fingers are disposed radially between the pull slide and the locking slide.

18. The tool of claim 17, wherein:

an interior lip of the locking slide forms a hinge mechanism with the pulling fingers to radially expand and collapse the pulling fingers.

19. The tool of claim 14, further comprising:

an ejector rod configured to eject the drive portion from the tool after installing the fastener portion with the hole.

20. The tool of claim 14, further comprising:

a retainer sleeve configured to retain the stationary fingers, and to guide the pulling fingers.

* * * * *